United States Patent [19]

Keck

[11] Patent Number: 4,537,098

[45] Date of Patent: Aug. 27, 1985

[54] TOOL FOR STRAIGHTENING JEWELRY CHAIN

[76] Inventor: John F. Keck, P.O. Box 35, Madison, Pa. 15663

[21] Appl. No.: 616,570

[22] Filed: Jun. 4, 1984

[51] Int. Cl.[3] ..... B25B 31/00

[52] U.S. Cl. ..... 81/488

[58] Field of Search ..... 81/3 R; 29/235, 90 R, 29/90.3, 90.2; 51/391, 392, 393; 49/488, 489, 498; 297/452

[56] References Cited

U.S. PATENT DOCUMENTS

| | | | |
|---|---|---|---|
| 1,839,557 | 1/1932 | Hilwig | 51/392 |
| 1,927,574 | 9/1933 | Parks | 51/392 |
| 2,007,067 | 7/1935 | Yarger | 81/3 R |
| 2,661,487 | 12/1953 | Hicks et al. | 29/235 |
| 3,596,539 | 8/1971 | Gollaher | 81/3 R |
| 4,471,526 | 9/1984 | Zaltsburg | 29/235 |

*Primary Examiner*—James L. Jones, Jr.
*Attorney, Agent, or Firm*—Jon M. Lewis

[57] ABSTRACT

A hand tool usable to remove kinks and bends from flat jewelry chain consists of a roller of glass or similar material and a handle bonded to the roller along one side thereof.

5 Claims, 3 Drawing Figures

TOOL FOR STRAIGHTENING JEWELRY CHAIN

BACKGROUND OF THE INVENTION

Flat gold chains are a popular item of jewelry. However, in the course of normal wear and handling, such chains frequently acquire kinks and bends which detract from the appearance thereof. Such bends and kinks are not easily removed by hand manipulation of the chain and attempts to use tools such as pliers and the like frequently result in greater damage to the chain. Consequently, it is normally necessary to incur the expense of the services of a jeweler.

SUMMARY OF THE INVENTION

The present invention pertains to tools for use with jewelry chain and, more particularly, to a hand held tool for straightening and removing kinks from such chain.

It is the primary object of the present invention to provided a tool for straightening chain jewelry.

It is also an object of the invention to provide such a tool which is easily used and which does not result in damage to the chain.

A further object of the invention is the provision of such a tool which is characterized by its simplicity of construction.

The above and other objects of the invention which will become apparent hereinafter are achieved by the provision of a jewelry chain straightening tool comprises of a roller of glass or Lucite and a handle secured along one side of the roller.

For a more complete understanding of the invention and the objects and advantages thereof reference should be had to the following detailed description and the accompanying drawing wherein a preferred embodiment of the invention is described and illustrated.

DETAILED DESCRIPTION OF THE INVENTION

Figure 2:
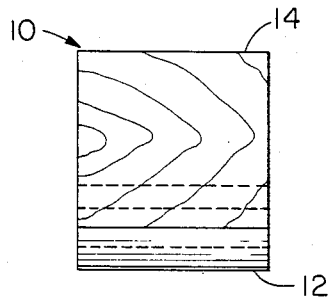
FIG. 2 is a side elevational view of the tool of FIG. 1.
Figure 3:
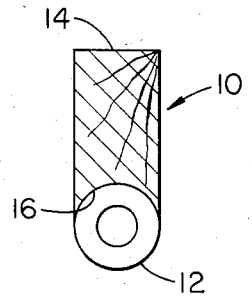
FIG. 3 is an end elevational view thereof.

Referring first to FIGS. 2 and 3, the chain straightening tool, designated generally by the reference 10 includes a cylindrical bar or roller formed of a hard, smooth surfaced material such as glass or Lucite. The roller 12 may be solid, or, as shown, tubular and is of uniform diameter. A handle of wood or other suitable material is secured by an adhesive, for example, along one side of the roller 12, the handle having a concave, semicylindrical recess 16 for this purpose. Preferably, the handle 14 is a wooden block having a length and thickness equal to the length and diameter, respectively, of the roller 12. The height of the handle may be any suitable dimension, typically, approximately twice the thickness thereof. By way of a non-limiting example, the roller 12 may be three and one quarter inches in length and three eighths inch in diameter with the overall length of the roller and handle being one inch.

Figure 1:
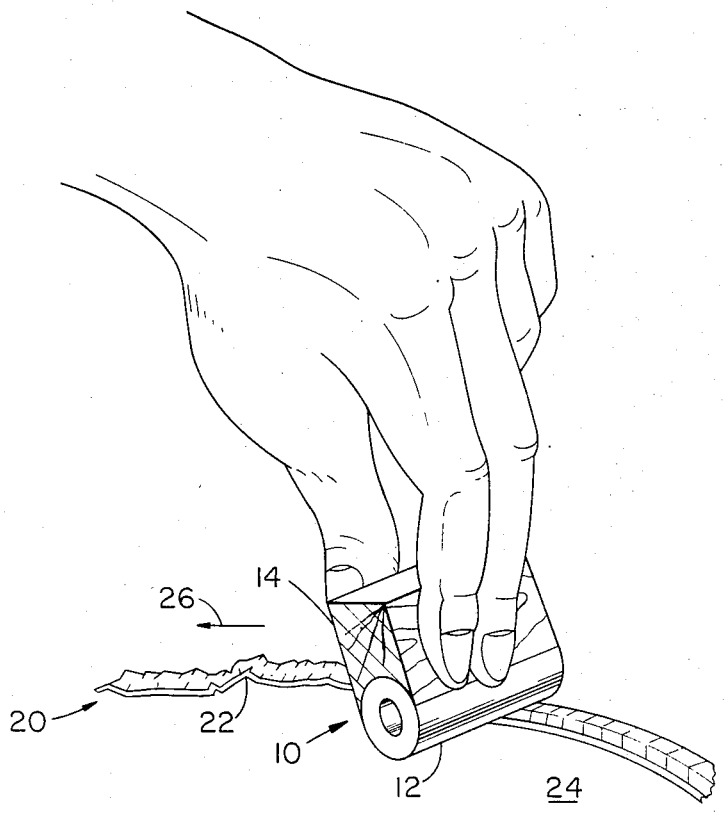
FIG. 1 is a perspective view showing the tool of the present invention employed to straighten a length of jewelry chain.

The manner of using the tool of the present invention is shown in FIG. 1. A length of jewelry chain 20 which is acquired kinks and bends 22 is placed on a hard, flat surface 24 such as a table top. The user grasps the handle 14 of the tool 10 between the thumb and the index and middle fingers of his hand, placing the roller in contact with the chain and drawing the tool there along in the direction of the arrow 24 while applying moderate pressure. While not shown, the user's hand, to the right of FIG. 1, holds the chain in place. After an initial pass along the chain, the chain is inverted and the rolling or smoothing process repeated.

It will be understood that while a preferred embodiment of the invention has been described, changes and additions may be made therein and thereto without departing from the spirit of the invention. Reference, should, accordingly be had to the appended claims in determining the true scope of the invention.

I claim:

1. A tool for removing kinks and bends from jewelry chain comprising:

a. a cylindrical member formed of a hard, smooth-surfaced, non-metallic material;

b. a handle adapted to be gripped between the thumb and fingers of a hand, said handle being of a thickness approximately equal to the diameter of said cylindrical member and having a concave, semicylindrical recess on one edge thereof; and c. adhesive means securing said handle by the recessed edge to said cylindrical member along the length thereof.

2. The tool of claim 1 wherein said cylindrical member is formed of glass.

3. The tool of claim 1 wherein said cylindrical member comprises a glass tube.

4. The tool of claim 1 wherein said cylindrical member is formed by Lucite.

5. The tool of claim 1 wherein said cylindrical member comprises a Lucite tube.

* * * * *